US005606801A

United States Patent [19]

Sundström

[11] Patent Number: 5,606,801

[45] Date of Patent: Mar. 4, 1997

[54] DRIVE SPROCKET DEVICE WITH FLANGES

[75] Inventor: Erik Sundström, Sandviken, Sweden

[73] Assignee: Sandvik AB, Sandviken, Sweden

[21] Appl. No.: 488,911

[22] Filed: Jun. 9, 1995

[30] Foreign Application Priority Data

Jun. 9, 1994 [SE] Sweden ..... 9401994

[51] Int. Cl.[6] ..... B27B 17/00

[52] U.S. Cl. ..... 30/384; 30/381; 474/158; 474/162

[58] Field of Search ..... 30/381, 382, 383, 30/384, 385, 386, 387; 474/158, 160, 162, 164

[56] References Cited

U.S. PATENT DOCUMENTS

| | | | |
|---|---|---|---|
| 3,144,890 | 8/1964 | Irgens | 30/383 X |
| 3,498,346 | 3/1970 | Gasner et al. | 30/381 X |
| 3,636,995 | 1/1972 | Newman | 30/386 X |
| 3,669,162 | 6/1972 | Irgens | 30/371 X |
| 3,857,179 | 12/1974 | Haupt et al. | 30/381 X |
| 4,506,444 | 3/1985 | Sundstrom | 30/384 X |
| 4,530,679 | 7/1985 | Reynolds | 30/381 X |
| 4,876,796 | 10/1989 | Calkins et al. | 30/384 X |
| 4,930,606 | 6/1990 | Sporzynski et al. | 188/218 XL |
| 5,021,033 | 6/1991 | Sundstrom | 474/152 X |
| 5,303,477 | 4/1994 | Kuzarov | 30/381 X |

FOREIGN PATENT DOCUMENTS

| | | | |
|---|---|---|---|
| 004137409 | 5/1993 | Germany | 30/381 |
| 093010951 | 6/1993 | WIPO | 30/381 |
| WO95/06549 | 3/1995 | WIPO . | |

*Primary Examiner*—Rinaldi I. Rada
*Assistant Examiner*—Boyer Ashley
*Attorney, Agent, or Firm*—Burns, Doane, Swecker & Mathis, L.L.P.

[57] ABSTRACT

A drive sprocket arrangement includes a drive sprocket and a drive ring rolling loosely on the outer periphery of the sprocket. Drive links of the saw chain enter recesses in the sprocket via orifices in the drive ring. The drive ring has at an axial inner edge thereof a radially inwardly directed flange to retain the ring on the sprocket, and at an axial outer edge thereof a radially outwardly directed flange to retain the chain in place. The flanges are arranged such that the axial inner edge will be disposed above the axial outer edge when the drive shaft of the chain saw points downwardly.

7 Claims, 1 Drawing Sheet

DRIVE SPROCKET DEVICE WITH FLANGES

BACKGROUND OF THE INVENTION

The present invention relates to drive sprocket assemblies for driving saw chains of chain saws.

In Swedish Patent Application 9302842-1 there is shown a drive sprocket device for the automatic tensioning of a saw chain on chain saws, where the saw chain runs around a loose outer drive ring rolling against an inner drive sprocket of a traditional rim sprocket. The rim sprocket is characterized by having a periphery with an annular row of recesses in which the drive links of the saw chain can enter, the width of the recesses being barely larger than the thickness of the drive links, and the row of recesses bordering cylindrical surfaces of the rim sprocket on both sides. The axial alignment between the drive ring and the drive sprocket is maintained by either two radially inward flanges on the drive ring, or two radially outward flanges on the drive sprocket. This prevents such displacements that could make the drive links climb out of the recesses.

A device with two flanges extending in the same direction works well for any orientation of the drive sprocket shaft, i.e., the shaft can point up or down without the drive ring sliding therefrom.

In many applications, there is no need to be concerned about upwardly directed shafts, either because the cutting heads of the vehicle-borne chain saws cannot be turned upside down, or because hand-held chain saws are rarely operated with the drive shaft directed upwardly and are never laid down with the shaft being upwardly directed, except for service.

SUMMARY OF THE INVENTION

The present invention concerns a drive sprocket device where a drive ring is rolling around a drive sprocket, and the drive ring has a radially inward flange at one axial end thereof and a radially outward flange at an axially opposite end to prevent axial displacement of the drive sprocket when the shaft is pointing downwards, and to make it easier to replace the saw chain and drive ring.

BRIEF DESCRIPTION OF THE DRAWING

The objects and advantages of the invention will become apparent from the following detailed description of a preferred embodiment thereof in connection with the accompanying drawing in which like numerals designate like elements, and in which.

DETAILED DESCRIPTION OF A PREFERRED EMBODIMENT OF THE INVENTION

Figure 1:
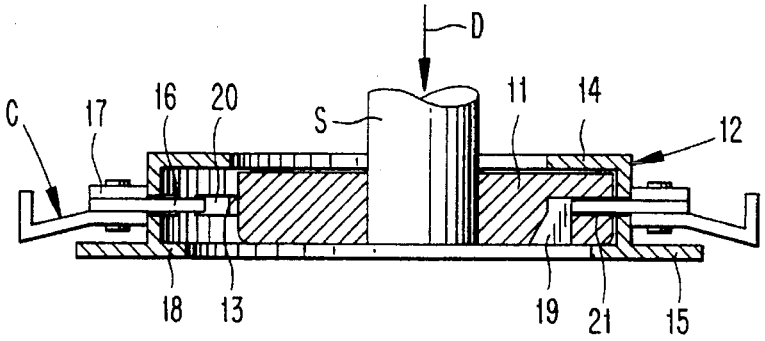
FIG. 1 is a longitudinal sectional view through a sprocket device according to the invention, with a drive shaft shown in phantom.
Figure 2:
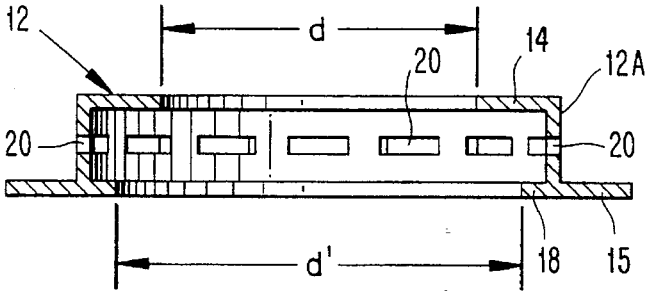
FIG. 2 is a longitudinal sectional view through a drive ring component of the sprocket device of FIG. 1.
Figure 3:
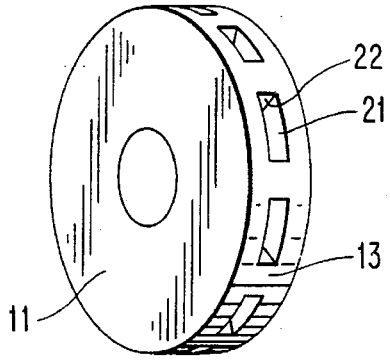
FIG. 3 is a perspective view of a conventional rim or drive sprocket used in the device of FIGS. 1 and 2.

The invention is described with reference to FIGS. 1 and 2, wherein FIG. 1 shows a cross section of a rim sprocket or drive sprocket 11 and a drive ring 12 rollingly supported by a cylindrical outer surface 13 disposed on the rim sprocket and carrying a saw chain C comprising drive links 16 and side links 17. The chain C is guided and supported by an outer cylindrical surface 12A of the drive ring 12 as the latter rolls around the outer surface 13 of the rim sprocket 11. An inner cylindrical surface 12B of the drive ring 12 has a diameter larger than an outer diameter of the sprocket 11. The drive links 16 of the chain penetrate orifices 20 in the drive ring in order to enter recesses 21 in the rim sprocket. Tangential forces are transmitted from the sprocket rim to the chain by rear edges 22 of the recesses. The rim sprocket is fastened directly to a drive shaft S as is conventionally provided on vehicle-borne chain saws, or it could be supported with a limited axial mobility on a spline shaft adjacent to a clutch drum, as is common on hand-held chain saws.

Figure 4:
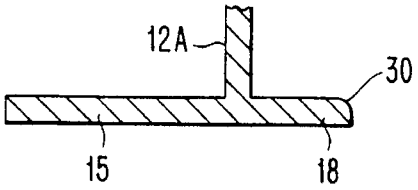
FIG. 4 is a fragmentary view of an alternative shape of a short flange of the device, according to the invention.
Figure 5:
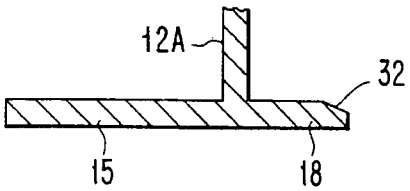
FIG. 5 is a view similar to FIG. 4 of yet another flange shape.

The drive ring 12 is according to the invention provided at an axial inner end or edge thereof with a radially inwardly directed flange 14 having an inner diameter d smaller than the outer diameter of the sprocket 11. This prevents the drive ring from falling off the sprocket 11 when the drive shaft is pointing in a downward direction D before the saw chain is mounted. At the outer axial end or edge of the drive ring there is one radially outwardly directed flange 15 which accommodates mounting of a saw chain and serves to hold the chain in place when the chain is not yet running or not yet under the tension. At the axial outer edge there may also be a short radially d' inwardly directed flange 18 having an inner diameter larger than the diameter of the sprocket 11, in order not to obstruct an axial mounting of the sprocket later than and separately from the drive ring. That is, the rim sprocket 11 can be inserted through the diameter d' to facilitate mounting of the rim sprocket. This will also improve the axial rolling precision of the drive ring against the rim sprocket, especially if saw dust has become caught between drive ring and sprocket. As rim sprockets are commonly provided with clearing holes 19 on the lower side for emptying of oil and sawdust brought into the recesses by the drive links, the short inward flange 18 must be short enough not to block these clearing holes. To keep the drive ring from climbing onto the cylindrical surfaces of the sprocket the side of the inner edge of the short inward flange 18 facing the sprocket 11 should preferably be rounded at 30 (FIG. 4) or tapered at 32 (FIG. 5).

Although the present invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. A drive mechanism for a saw chain, comprising:

a rotatably driven drive shaft, a drive sprocket operably connected to said drive shaft to be rotated by said drive shaft, said drive sprocket including an outer cylindrical surface having an annular row of circumferentially spaced recesses; and a drive ring having an inner cylindrical surface of larger diameter than said outer cylindrical surface of said drive sprocket and loosely mounted thereon, said drive ring including an annular row of circumferentially spaced orifices through which drive links of the saw chain extend to enter and be driven by said recesses, said drive ring including an axial inner end and an axial outer end, a radially inwardly projecting flange disposed at said axial inner end, and a radially outwardly projecting flange disposed at said axial outer end.

2. The drive mechanism according to claim 1, wherein said drive ring further includes at said axial outer end another radially inwardly projecting flange having a shorter radial length than said radially outwardly projecting flange.

3. The drive mechanism according to claim 1, wherein said inwardly projecting flange defines an inner diameter smaller than an outer diameter of said drive sprocket.

4. The drive mechanism according to claim 2, wherein said inwardly projecting flange defines an inner diameter smaller than an outer diameter of said drive sprocket.

5. The drive mechanism according to claim 4, wherein said other flange defines an inner diameter larger than said outer diameter of said drive sprocket.

6. The drive mechanism according to claim 5, wherein said other flange includes an inner edge defining said inner diameter, said inner edge including a side facing said drive sprocket, said side being rounded.

7. The drive mechanism according to claim 5, wherein said other flange includes an inner edge defining said inner diameter, said inner edge including a side facing said drive sprocket, said side being tapered.

* * * * *